US007011058B2

(12) United States Patent
Kinugawa

(10) Patent No.: US 7,011,058 B2
(45) Date of Patent: Mar. 14, 2006

(54) VALVE TIMING ADJUSTING DEVICE

(75) Inventor: Hiroyuki Kinugawa, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/832,233

(22) Filed: Apr. 27, 2004

(65) Prior Publication Data

US 2004/0244746 A1 Dec. 9, 2004

(30) Foreign Application Priority Data

Jun. 5, 2003 (JP) ..... 2003-161048

(51) Int. Cl.
*F01L 1/34* (2006.01)

(52) U.S. Cl. ..... 123/90.17; 123/90.15; 123/90.27

(58) Field of Classification Search ..... 123/90.15, 123/90.16, 90.17, 90.18, 90.27, 90.31; 464/1, 464/2, 160
See application file for complete search history.

(56) References Cited

U.S. PATENT DOCUMENTS

| | | | | |
|---|---|---|---|---|
| 5,836,275 | A * | 11/1998 | Sato | 123/90.17 |
| 6,450,137 | B1 * | 9/2002 | Ogawa | 123/90.17 |
| 6,523,511 | B1 * | 2/2003 | Hase | 123/90.17 |

FOREIGN PATENT DOCUMENTS

| | | | |
|---|---|---|---|
| JP | 4-14549 | A | 1/1992 |
| JP | 9-264110 | A | 10/1997 |
| JP | 9-303118 | A | 11/1997 |
| JP | 2002-097911 | A | 4/2002 |
| JP | 2-3365199 | B | 4/2004 |

* cited by examiner

*Primary Examiner*—Thomas Denion
*Assistant Examiner*—Ching Chang
(74) *Attorney, Agent, or Firm*—Sughrue Mion, PLLC

(57) ABSTRACT

A valve timing adjusting device including a first rotor, a lock pin for locking a relative rotation between the first rotor and a second rotor at the most advanced position, and operating by fluid control pressure to release the lock, wherein rotor start-up delaying means is provided for operating the lock pin by the fluid control pressure in the lock releasing direction, and then rotating the second rotor in the lagged direction when the second rotor starts rotating from the most advanced position to the lagged direction.

11 Claims, 5 Drawing Sheets

VALVE TIMING ADJUSTING DEVICE

BACKGROUND OF THE INVENTION

1. Field of the Invention

The present invention relates to a valve timing adjusting device for changing opening and closing timing of one or both of an intake valve and an exhaust valve of an internal combustion engine according to operating conditions of the engine.

2. Description of the Related Art

It has been already known a conventional valve timing adjusting device disclosed in JP 3365199 B in which the device includes a first rotor rotating synchronously with a crank shaft of an internal combustion engine and a second rotor integrally secured on an end face of a camshaft and fitted in the first rotor rotatably relative to the first rotor, wherein a relative rotating position between the first rotor and the second rotor is controlled by advanced side hydraulic pressure or lagged side hydraulic pressure applied by a hydraulic control valve. Moreover, the valve timing adjusting device is arranged so as to lock a relative rotation between the first rotor and the second rotor by engaging a rotation restricting member (lock pin) received in either of the first rotor or the second rotor in an engaging hole formed in the other rotor when stopping or starting an operation of the internal combustion engine where no working fluid is being supplied thereto; and further is arranged so as to release the lock by pressure of the working fluid applied to a lagged side oil pressure chamber.

The conventional valve timing adjusting device is arranged as mentioned above. Accordingly, the lock between the first rotor and the second rotor is released by disengaging the lock pin from an engaging hole by pressure of the working fluid applied to the lagged side oil pressure chamber. At that time, the hydraulic pressure for operating the second rotor in the lagged direction releases an engagement of the lock pin in the engaging hole, however, the lagged side oil pressure chamber communicates with an oil passage of the working fluid supply and exhaust system while the lock pin is engaged in the engaging hole. For this reason, reaction force of the above cam facilitates rotation of the second rotor, but causes the lock pin and the side wall of the engaging hole to gall, which increases the possibility that the lock pin cannot disengage from the engaging hole, thereby bringing the device into out of control.

SUMMARY OF THE INVENTION

The present invention has been made to solve the above-mentioned problem. An object of the present invention is to provide a valve timing adjusting device with high reliability which is able to release lock of both rotors by a lock pin before staring a relative rotation of the first rotor and the second rotor and perform continually stable control.

The valve timing adjusting device according to the present invention includes a first rotor rotatably provided on a camshaft of a system opening and closing at least one intake valve and exhaust valve of an internal combustion engine, and rotatably driven by an output produced by the internal combustion engine; a second rotor fitted in the first rotor relatively rotatably and connected to the camshaft; and a lock pin operating by mechanical urging force to lock a relative rotation between the first rotor and the second rotor at the most advanced position, and operating by a fluid control pressure to release the lock, wherein rotor start-up delaying means is provided for operating the lock pin by the fluid control pressure in the lock releasing direction, and then rotating the second rotor in the lagged direction when the second rotor starts rotating from the most advanced position in the lagged direction.

Therefore, according to the present invention, the lock pin placed in a relative rotation lock position allows a smooth release of the lock of both rotors by the lock pin before the second rotor starts a relative rotation in the lagged direction. Accordingly, this enables the device to be continually perform stable control, thereby improving reliability of the valve timing adjusting device.

DETAILED DESCRIPTION OF THE PREFERRED EMBODIMENTS

Preferred embodiments of the present invention will now be described as below with reference to the attached drawings.

First Embodiment

Figure 1:
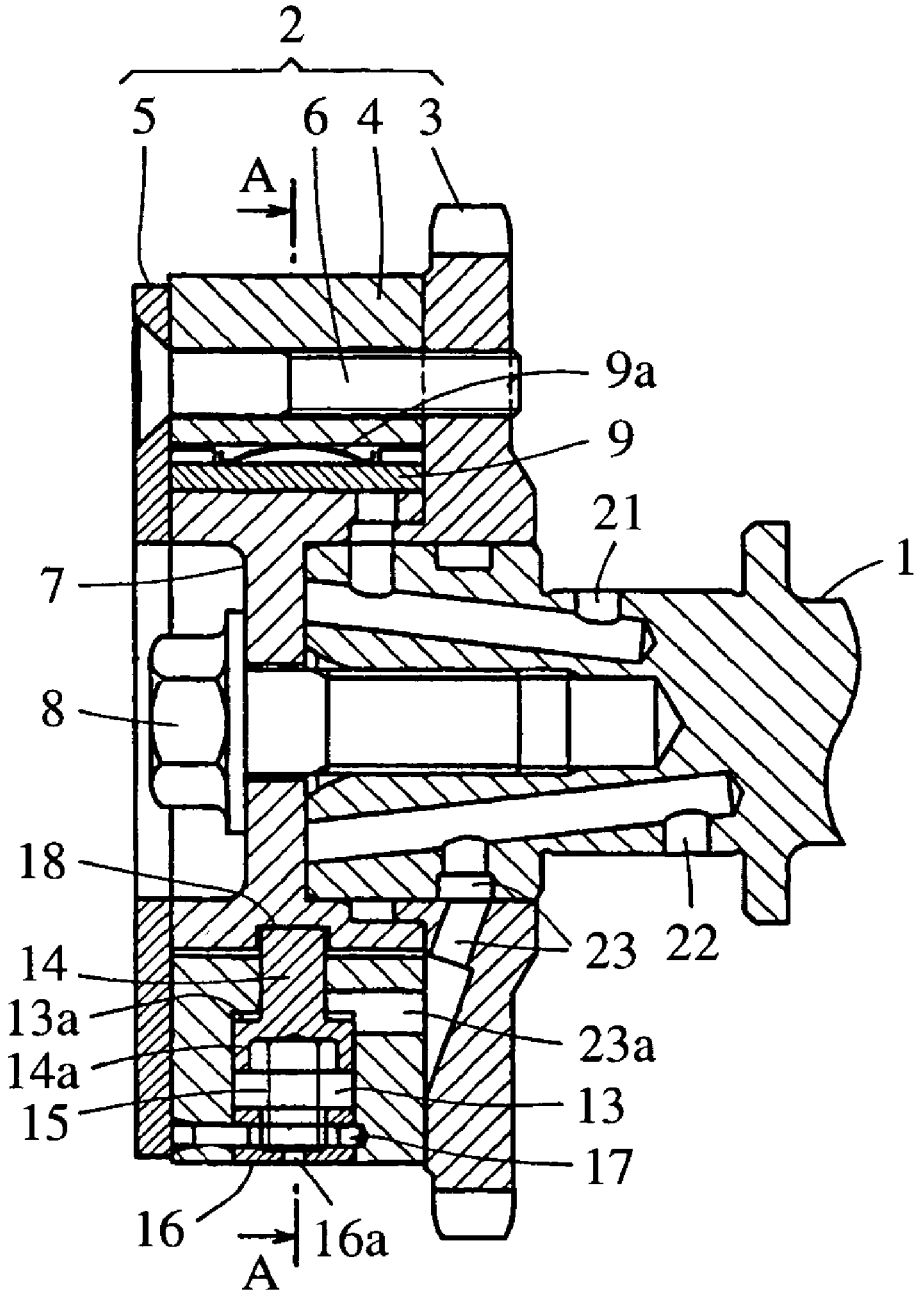
FIG. 1 is a sectional view showing a valve timing adjusting device according to a first embodiment of the present invention.

FIG. 1 is a sectional view showing a valve timing adjusting device according to a first embodiment of the present invention.

Figure 2:
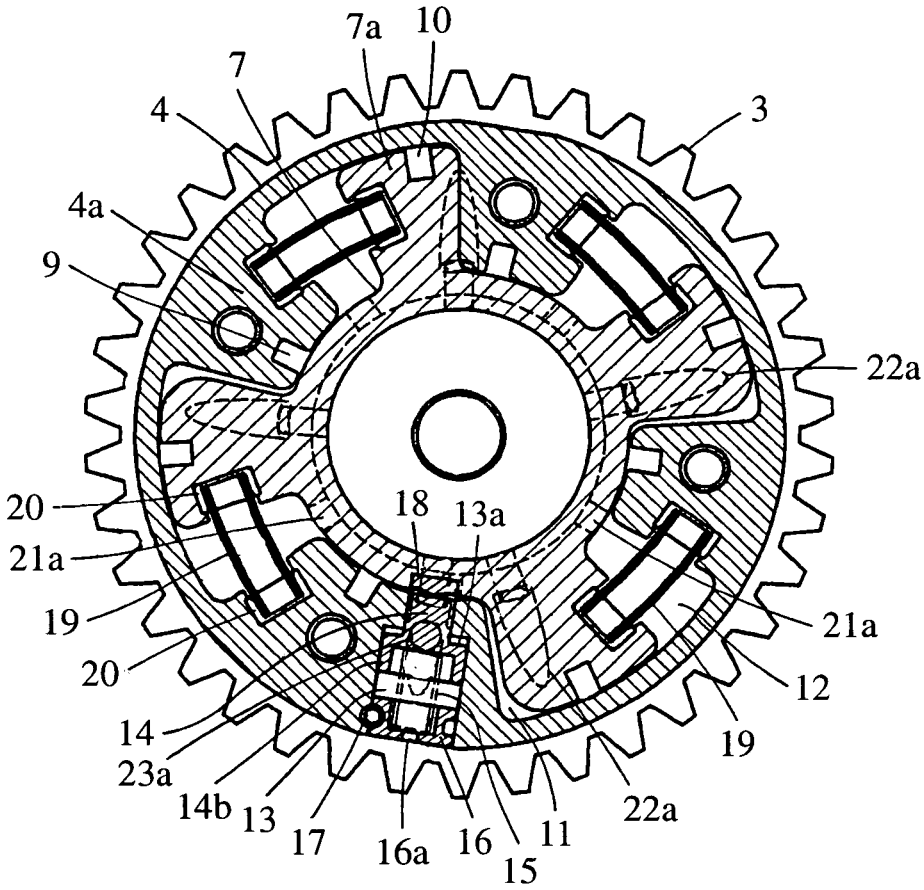
FIG. 2 is a sectional view taken along the line A—A of FIG. 1.

FIG. 2 is a sectional view taken along the line A—A of FIG. 1.

Figure 3:
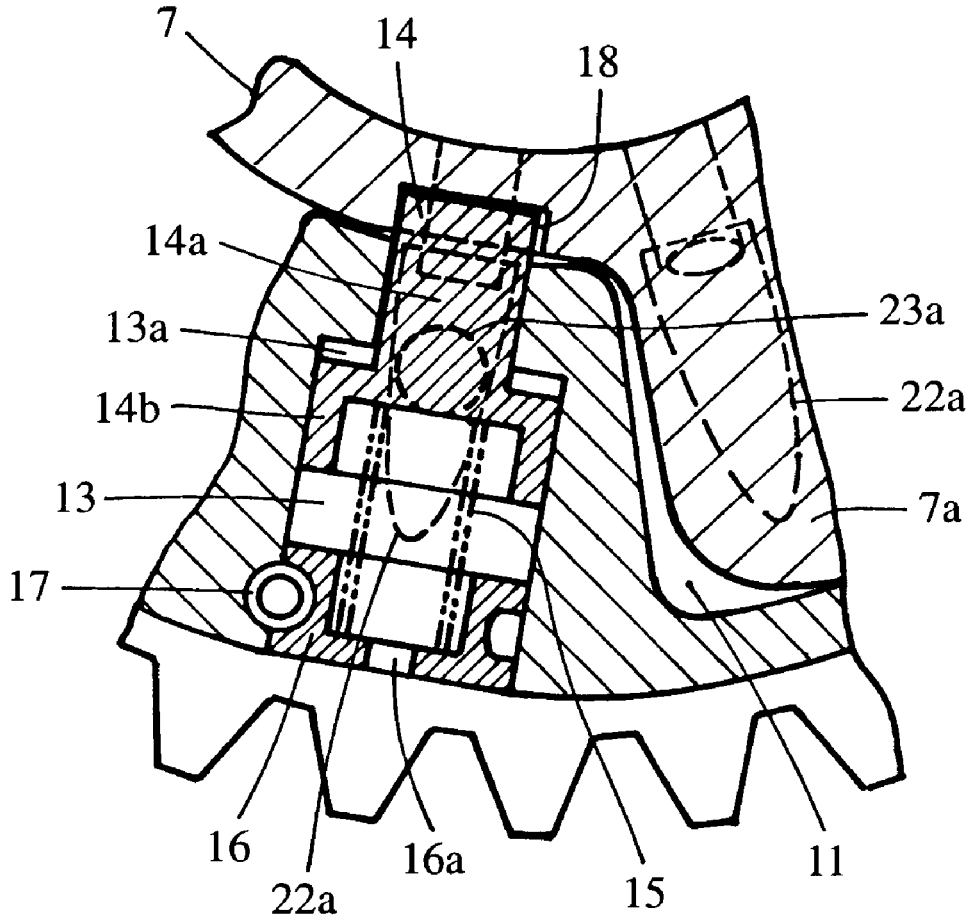
FIG. 3 is an enlarged sectional view in the vicinity of the lock pin shown in FIG. 2.
Figure 4:
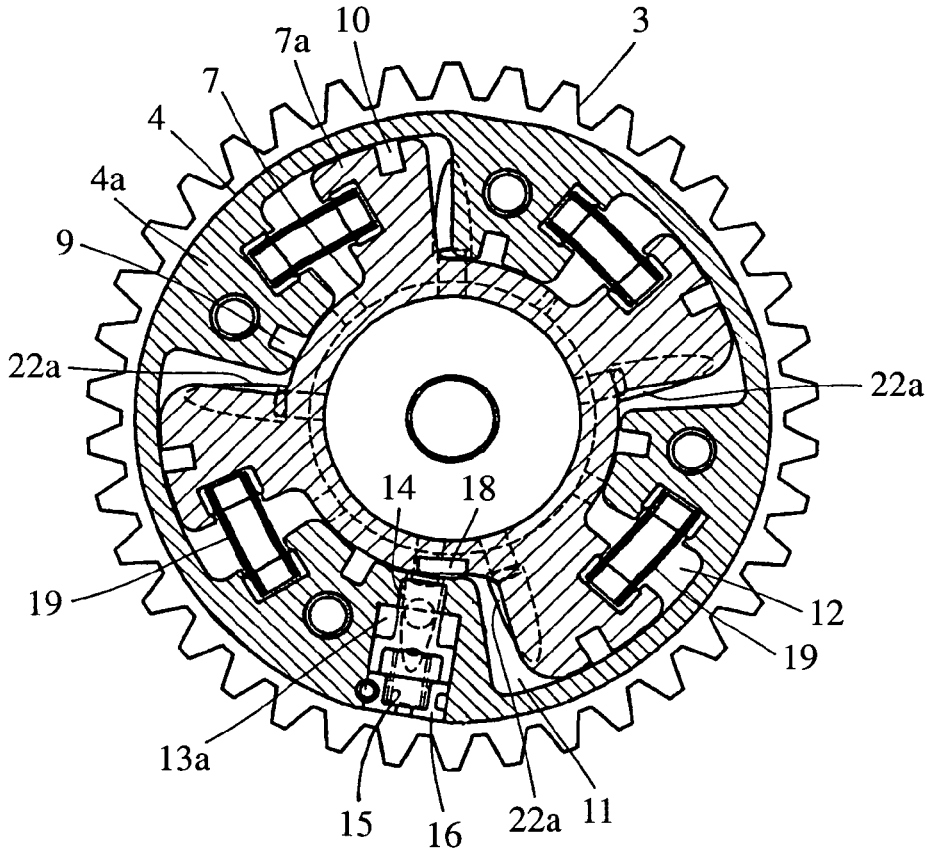
FIG. 4 is a sectional view explaining an operation of a valve timing adjusting device according to a first embodiment.

FIG. 3 is an enlarged sectional view in the vicinity of the lock pin shown in FIG. 2.

Referring to FIGS. 1–3, a first rotor 2 rotating synchronously with a crank shaft (not shown) of the internal combustion engine is rotatably provided on the camshaft 1 of system opening and closing an intake and exhaust valve of an internal combustion engine. The first rotor 2 takes a housing structure composed of a timing rotor 3 (timing sprocket or timing pulley) rotatably fitted and held on the camshaft 1, a case 4 having a cylindrical shape assembled and secured on one side surface of the timing rotor 3, and a cover 5 to secure in sandwich relation the case 4 between the timing rotor 3 and the cover 5. The above timing rotor 3, case 4, and cover 5 are integrally fastened together with one another by a fastening bolt (first fastening member) 6. Moreover, an internal peripheral surface of the case 4 integrally has a plurality of shoes 4*a* extending toward the center of the rotational direction of the camshaft 1 as shown in FIG. 2.

To the end face of the camshaft 1 is fastened and secured a rotor 7 for synchronously rotating with the camshaft 1 by an axial bolt (second fastening member) 8. The rotor 7 is rotatably received within the case 4. Accordingly, the rotor 7 serves as a second rotatable relative to the first rotor 2. The rotor 7 integrally has a plurality of (of the same number as that of the shoes 4*a*) vanes 7*a* radially extending from an external periphery of the rotor 7 between one shoe 4*a* and another shoe 4*a* as shown in FIG. 2. In the tip of each of the shoe 4*a* is provided a chip seal 9 having a back spring (leaf spring) 9*a* as shown in FIG. 1. The chip seal 9 slides on and contacts with a rotary drum of the rotor 7 with urging force of the back spring 9*a* as a back pressure. Similarly, in the tip of each of the vane 7*a* is provided a chip seal 10 having a back spring (not shown), and sliding on and contacting with the internal peripheral surface of the case 4 between one shoe 4*a* and another shoe 4*a*.

The shoes 4*a* forms an oil pressure chamber and the oil pressure chamber is each partitioned into a lagged side oil pressure chamber 11 and an advanced side oil pressure chamber 12 by the vane 7*a*. Those lagged side oil pressure chambers 11 and advanced side oil pressure chambers 12 are each formed into a space having a fan-shaped section formed by the shoe 4*a* and the vane 7*a* between the case 4 and the rotor 7, and to each of these chambers is fed working fluid. The specific oil passages for supplying the working fluid thereto and exhausting it therefrom will be described later.

In the case 4 of the first rotor 2 is provided a lock pin receiving hole 13 extending radially toward the rotation center of the valve timing adjusting device. In the lock pin receiving hole 13 is slidably inserted a lock pin 14 for locking a relative rotation between the case 4 of the first rotor 2 and the rotor 7 as the second rotor when the relative position between both rotors reaches a predetermined position. The lock pin 14 is made up of a stepped pin having a small portion 14*a* and a large portion 14*b* as shown in FIG. 3. The large portion 14*b* is formed into a shape having concaved section whose rear end surface, opposing to the small portion 14*a*, is opened.

Moreover, the lock pin receiving hole 13 receives a spring 15 (first urging member) urging the lock pin 14 in the direction in which the lock pin engages with the rotor 7. The spring 15 is held down between the lock pin 14 and a stopper 16 engaged with the lock pin receiving hole 13 by the stopper. The stopper 16 is secured to the case 4 by a slip-out stopping pin 17. Here, a lock releasing oil pressure chamber 13*a* is provided in the lock pin receiving hole 13, which is formed on the fore end side (small portion 14*a* side) of the large portion 14*b* by partitioning the lock pin receiving hole by the large portion 14*b* of the lock pin 14. Further, an exhaust hole 16*a* is formed in the stopper 16.

An engaging hole 18 is formed in the rotor 7 for engageably and disengageably engaging the lock pin 14 at the most advanced position of the rotor 7 (vane 7*a*). Moreover, in each of the advanced side oil pressure chambers 12 is provided an assist spring 19 (second urging member) interposed between the 4*a* and the vane 7*a* for urging the vane 7*a* in the lagged direction. The assist spring 19 is for moving a relative rotating position of the second rotor 7 (rotor) in the advanced direction against the reaction force in the lagged direction, suffered by the camshaft 1 when stopping or starting an operation of the internal combustion engine where no hydraulic pressure is being supplied thereto. At both ends of each of the assist spring 19 are secured a holder 20. The assist spring 19 is assembled so as to bridge over the shoe 4*a* and the vane 7*a* by fitting the holder 20 in concavity formed on each of the opposing sides of the shoe 4*a* and the vane 7*a*. The holder 20 improves assemblage of the assist spring 19 and prevents the assist spring 19 from interfering by itself.

The oil passage of the working fluid supply and exhaust system to the lagged side oil pressure chamber 11 and to the advanced side oil pressure chamber 12, and of that to the lock releasing oil pressure chamber 13*a* will now be described below.

In the camshaft 1 is provided a first oil passage 21 feeding the working fluid to each of the advanced side oil pressure chambers 12 and a second oil passage 22 for feeding the working fluid to each of the lagged side oil pressure chambers 11. The working fluid is fed to these oil passages 21 and 22 from working fluid feeding means through an oil pressure control valve (OCV, not shown). Here, the first oil passage 21 communicates with the advanced side oil pressure chamber 12 through a first oil passage 21*a* provided in the second rotor 7. Further, the second oil passage 22 communicates with the lagged side oil pressure chamber 11 through a second oil passage 22*a* provided in the timing rotor 3 of the first rotor 2.

In addition, in the camshaft 1 and the timing rotor 3 is provided a third oil passage 23 branched from the second oil passage 22. The third oil passage 23 communicates with the lock releasing oil pressure chamber 13*a* through a third oil passage 23*a* provided on the case 4 side of the first rotor 2.

In the system of the valve timing adjusting device mentioned above, the second oil passage 22*a* provided on the timing rotor 3 side of the first rotor 2 is closed by the vane 7*a* at the most advanced position of the rotor 7 as the second rotor, and when the rotor 7 starts rotating by the reaction force of the cam in the lagged direction from the most advanced position, the second oil passage 22*a* communicates with the lagged side oil pressure chamber 11 because the closing by the vane 7*a* is released at that time. For this reason, the lock pin 14 is arranged so as to be disengaged from the engaging hole 18 by pressure of the working fluid till the second oil passage 22*a* communicates with the lagged side oil pressure chamber 11 by rotation of the rotor 7 in the lagged direction caused by the reaction force of the cam. Accordingly, the second oil passage 22*a* and the vane 7*a* to close the oil passage 22*a* at the most advanced position of the rotor 7 act as the rotor start-up delaying means for regulating the rotation of the rotor 7 in the lagged direction until the lock pin 14 is disengaged from the engaging hole 18.

The operation of the first embodiment will now be described below.

In the absence of hydraulic pressure when the internal combustion engine is stopped or is started, the lock pin 14 is engaged in the urging hole 18 at the most advanced position of the rotor (the second rotor) 7 by the urging force of the spring (first urging member) 15. When the engine is started from this state, the working fluid is fed from the working fluid feeding system to the advanced side oil pressure chamber 12 via the first oil passages 21, 21*a*. The hydraulic pressure induced by the working fluid which is fed to the advanced side oil pressure chamber 12 maintains the rotor 7 at the most advanced position relative to the first rotor 2. However, the lock pin 14 is not disengaged from the engaging hole 18 at that time because working fluid has not yet been supplied to the second oil passages 22, 22*a*.

Depending on operating conditions of the internal combustion engine, it is possible to feed the working fluid to the lagged side oil pressure chamber 11 from the second oil passages 22, 22*a* and to exhaust the working fluid remaining in the advanced side oil pressure chamber 12 from the first oil passages 21, 21*a* when the relative position of the rotor 7 relative to the first rotor 2 rotates in the lagged direction.

However, in the state where the lock pin 14 is engaged in the engaging hole 18, communication between the second oil passage 22*a* on the rotor 7 side and the lagged side oil pressure chamber 11 is closed by the vane 7*a* of the rotor 7. Therefore, the working fluid is not fed to the lagged side oil pressure chamber 11, and the rotor 7 does not start operating. In this state, the working fluid is fed to the second oil passages 22, 22*a*, but is not fed to the lagged side oil pressure chamber 11. During this period of time, the working fluid is fed to the lock releasing oil pressure room 13*a* via the third oil passages 23, 23*a* branched from the second oil passage 22 of the camshaft 1. When the hydraulic force of the working fluid applied to the lock releasing oil pressure room 13*a* surpass the urging force of the spring 15 provided in the system of the lock pin 14, the lock pin 14 moves against the urging force of the spring 15. Thereby, the lock pin 14 is disengaged from the engaging hole 18 to release the relative rotating restriction between the first rotor 2 and the rotor 7 as the second rotor.

Here, when the internal combustion engine is in operation, the camshaft 1 is subjected to reaction force (reaction force of the cam) acting in opposition to that induced by the valve spring of the intake and exhaust valve in the rotating direction. Since the rotor 7 as the second rotor is integrally secured to the camshaft 1, the rotor 7 is continuously subjected to the reaction force of the cam, in other words, the force delays the relative rotating position of the rotor 7 relative to the first rotor 2 in the lagged direction, and since the lock pin 14 is disengaged from the engaging hole 18 as mentioned above, stopping a supply of the working fluid to the advanced side makes the rotor 7 as the second rotor starts rotating in the lagged direction. The rotation of the rotor 7 in the lagged direction communicates between the second oil passage 22*a* and the lagged side oil pressure chamber 11 being closed at the most advanced position, thereby enabling the hydraulic control of the relative rotating position of the rotor 7.

As mentioned above, according to the first embodiment, the valve timing adjusting device is arranged so as to include rotor start-up delaying means for starting rotating the rotor 7 in the lagged direction by the reaction force of the cam after the engagement between the lock pin 14 and the engaging hole 18 is released by the hydraulic pressure of the working fluid applied to the lock releasing oil pressure chamber 13*a* from the third oil passages 23, 23*a*, before the rotor 7 situated at the most advanced position while the internal combustion engine is in operation. As a result, the working fluid fed to the lagged side oil pressure chamber 11 and reaction force of the cam prevent the lock pin 14 and the engaging hole 18 from sticking in the rotating direction of the rotor 7. Therefore, disengagement of the lock pin 14 is always possible, thereby performing continually stable control of the valve timing adjusting device.

Second Embodiment

Figure 5:
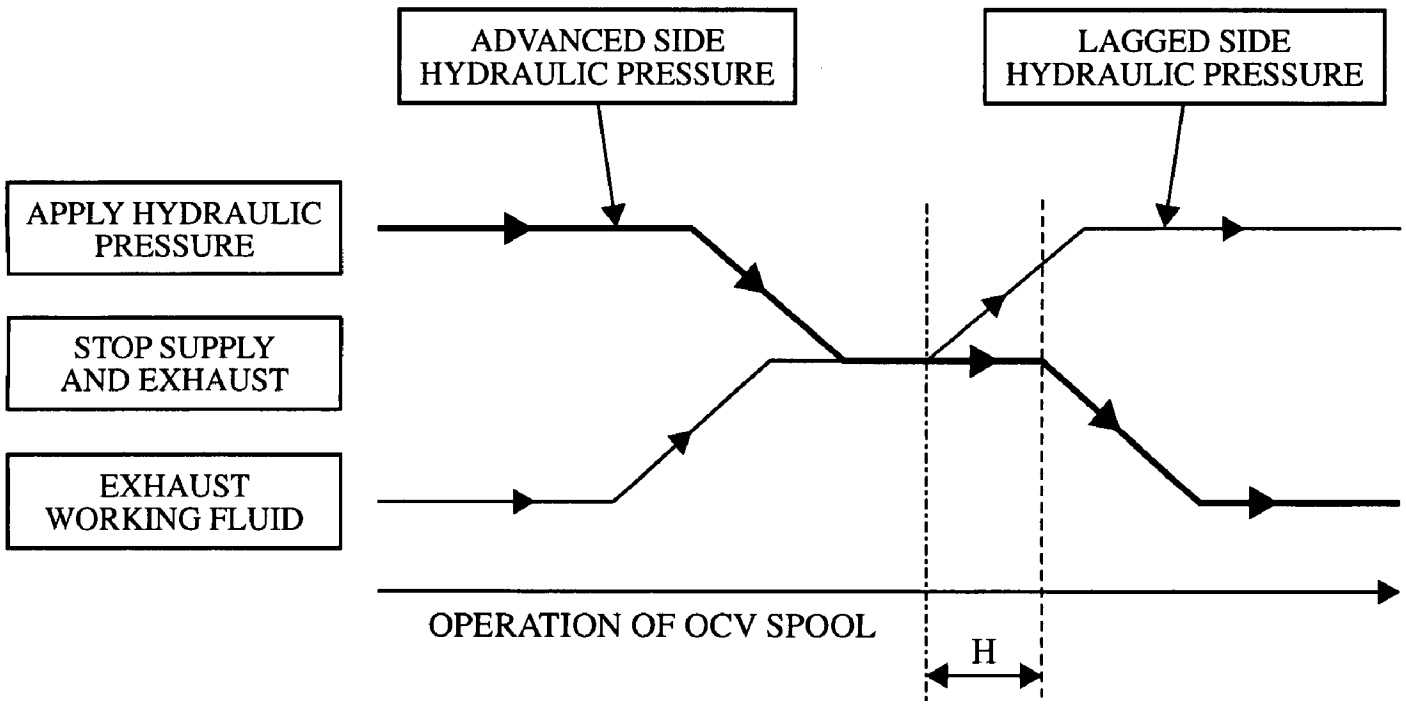
FIG. 5 is a timing flow chart explaining an operation and functions of the OCV of a valve timing adjusting device according to a second embodiment of the present invention.

FIG. 5 is a timing flow chart showing an operation and functions of the OCV of a valve timing adjusting device according to the second embodiment of the present invention.

In the second embodiment, the OCV (not shown) provided in a hydraulic pressure supply and exhaust system, which supplies working fluid to and exhausts it from a lagged side oil pressure chamber 11 and an advanced side oil pressure chamber 12 is applied as rotor start-up delaying means. Generally, in an OCV of this kind, straightly moving the spool of the OCV switches the feeding path of working fluid. In the OCV according to the second embodiment, it is arranged such that the working fluid is fed previously to the lagged side oil pressure chamber 11 and to the lock releasing oil pressure chamber 13*a* by delaying exhaust of the working fluid from the lagged side oil pressure chamber 11 compared with that from the advanced side oil pressure chamber 12. The OCV according to the second embodiment, as shown in FIG. 5, is arranged such that an interval "H" is set, during which the working fluid in the advanced side oil pressure chamber 12 (advanced side hydraulic pressure) is unable to exhaust, and the working fluid is fed to the lock releasing oil pressure chamber 13*a* during the interval "H" to build the hydraulic pressure within the lock releasing oil pressure chamber 13*a*, thereby preferentially disengaging the lock pin 14.

Through the structure thus arranged according to the second embodiment, the OCV preferentially disengages the lock pin 14 from the engaging hole, and after that exhausts the working fluid from the advanced side oil pressure chamber 12. As a result, the lock pin can be disengaged stably, which makes the second rotor 7 smoothly rotate in the lagged direction.

Third Embodiment

According to third embodiment, rotor start-up delaying means is implemented by making larger the friction resistance of the chip seals 9 and 10 to seal the sliding and contacting portions between the first rotor 2 and the rotor 7 as the second rotor than the pressure of the working fluid (fluid control pressure) to make the lock pin 14 operate in the disengaging direction. In this way, the effect similar to that of the second embodiment can be obtained by increasing the friction resistance of the chip seals 9 and 10.

Fourth Embodiment

According to the forth embodiment, rotor start-up delaying means is implemented by narrowing down the oil passage (not shown) on the drain side of the hydraulic pressure supply and exhaust system for supplying the working fluid to and exhausting it from the lagged side oil pressure chamber 11 and the advanced side oil pressure chamber 12. Even in the fourth embodiment, the effect similar to that of the second embodiment can also be obtained.

Fifth Embodiment

In the first embodiment, the second oil passage 22*a* provided in the timing rotor 3 of the first rotor 2 is arranged so as to be closed by the vane 7*a* at the most advanced position of the rotor 7, however, the second oil passage 22*a* may be narrowed down the communicating portion formed between the second oil passage 22*a* and the lagged side oil pressure chamber 11 by the vane 7*a* at the most advanced position of the rotor 7. Also, even in the fifth embodiment, the above-described arrangement can function as the rotor start-up delaying means in the same manner as that of each of above Embodiments.

What is claimed is:

1. A valve timing adjusting device comprising:

a first rotor rotatably provided on a camshaft of a system opening and closing at least one intake valve and exhaust valve of an internal combustion engine, and rotatably driven by an output produced by the internal combustion engine, said first rotor having an oil passage which feeds fluid to a lagged side oil pressure chamber;

a second rotor fitted in the first rotor relatively rotatably and connected to the camshaft, said second rotor including a plurality of radially extending vanes; and a lock pin which operates by a mechanical urging force to lock a relative rotation between the first rotor and the second rotor at a most advanced position, the lock pin being released by a fluid control pressure, wherein at least one vane of the second rotor at least partially covers the oil passage when the lock pin locks the relative rotation between the first rotor and the second rotor, such that when the lock pin is operated by the fluid control pressure in a lock releasing direction, the second rotor is subsequently rotated away from the most advanced position.

2. The valve timing adjusting device according to claim 1, wherein the oil passage of the lagged side is provided on the first rotor, and is at least partially closed by the second rotor at the most advanced position of the second rotor, and the oil passage feeds working fluid to the lagged side oil pressure chamber when the lock pin is released.

3. The valve timing adjusting device according to claim 1, further including friction resistance provided by a chip seal to seal a sliding and contacting portion between the first rotor and the second rotor, the friction resistance being larger than the fluid control pressure to be acted on the lock pin in the lock releasing direction.

4. The valve timing adjusting device according to claim 1, further including a narrowed down oil passage portion on a drain side of a hydraulic pressure supply and exhaust system for supplying working fluid to and exhausting it from an advanced side oil pressure chamber and a lagged side oil pressure chamber.

5. The valve timing adjusting device according to claim 1, further including an oil control valve provided in a hydraulic pressure supply and exhaust system for supplying working fluid to and exhausting it from an advanced side oil pressure chamber and the lagged side oil pressure chamber, and for opening a drain of the advanced side oil pressure chamber after the working fluid is fed to the lagged side oil pressure chamber.

6. The valve timing adjusting device according to claim 1, wherein the second rotor is arranged so as to start rotating from the most advanced position to a lagged direction by reaction force of a cam generated in the camshaft when starting an operation of the internal combustion engine.

7. The valve timing adjusting device according to claim 1, wherein an assist spring is provided between a shoe of the first rotor and at least one of the vanes of the second rotor for moving a relative rotating position of the second rotor in the advanced direction against reaction force of the cam generated in the camshaft when stopping or starting an operation of the internal combustion engine.

8. The valve timing adjusting device of claim 1, wherein the lock pin is movable in a radial direction of the first rotor.

9. The valve timing adjusting device according to claim 1, wherein the first rotor is positioned to surround the second rotor.

10. The valve timing adjusting device of claim 1, wherein the lock pin includes a shoulder area and is provided in a recess, such that the fluid control pressure is applied at the shoulder area to press the lock pin along the recess.

11. A valve timing adjusting device comprising:

a first rotor rotatably provided on a camshaft of a system opening and closing at least one intake valve and exhaust valve of an internal combustion engine, and rotatably driven by an output produced by the internal combustion engine;

a second rotor fitted in the first rotor relatively rotatably and connected to the camshaft; and a lock pin operating by mechanical urging force to lock a relative rotation between the first rotor and the second rotor at the most advanced position, and operating by fluid control pressure to release the lock, wherein rotor start-up delaying means is provided for operating the lock pin by the fluid control pressure in the lock releasing direction, and then rotating the second rotor in the lagged direction when the second rotor starts rotating from the most advanced position to the lagged direction, and wherein the rotor start-up delaying means has friction resistance of a chip seal to seal a sliding and contacting portion between the first rotor and the second rotor larger than the fluid control pressure to be acted on the lock pin in the lock releasing direction.

* * * * *